US005820067A

United States Patent [19]

Orbons et al.

[11] Patent Number: 5,820,067

[45] Date of Patent: Oct. 13, 1998

[54] IMAGE-FORMING APPARATUS PROVIDED WITH A SUPPORT FOR A ROLL OF RECEIVING MATERIAL

[75] Inventors: Wilhelmus Hendrikus Maria Orbons, Grubbenvorst; Marcel Pierre Joseph Marie Teheux, Eindhoven, both of Netherlands

[73] Assignee: OCE-Nederland B.V., Venlo, Netherlands

[21] Appl. No.: 935,857

[22] Filed: Sep. 23, 1997

Related U.S. Application Data

[63] Continuation of Ser. No. 601,771, Feb. 15, 1996, abandoned.

[30] Foreign Application Priority Data

Feb. 15, 1995 [NL] Netherlands ..... 9500278

[51] Int. Cl.[6] ..... B65H 19/00

[52] U.S. Cl. ..... 242/560; 242/595; 347/261; 248/318; 399/391

[58] Field of Search ..... 242/560, 558, 242/560.2, 561, 595, 533, 533.7, 598.3, 598.4; 399/384, 389, 391, 393, 395; 347/262, 264; 248/346.03, 311.2, 318, 320, 544, 346.11; 271/109, 314

[56] References Cited

U.S. PATENT DOCUMENTS

| | | | |
|---|---|---|---|
| 3,702,672 | 11/1972 | Becht | 242/560 X |
| 3,718,302 | 2/1973 | Mount et al. | 42/533.7 X |
| 3,995,747 | 12/1976 | Lewey et al. | 242/533.7 X |
| 4,557,029 | 12/1985 | Stewart . | |
| 4,595,273 | 6/1986 | Watanabe et al. | 399/391 X |
| 4,706,099 | 11/1987 | Suzuki | 399/385 X |
| 4,885,613 | 12/1989 | Kudoh | 399/384 X |
| 4,903,910 | 2/1990 | Tamura | 242/558 |
| 5,029,376 | 7/1991 | Sharp, Jr. . | |
| 5,067,664 | 11/1991 | Matsuyama | 242/595 X |
| 5,244,163 | 9/1993 | Matsuo et al. . | |
| 5,279,472 | 1/1994 | Hongo et al. | 242/595 X |
| 5,449,127 | 9/1995 | Davis | 242/598.3 X |

FOREIGN PATENT DOCUMENTS

| | | | |
|---|---|---|---|
| 597168 | 1/1993 | European Pat. Off. . | |
| 3721356 | 1/1989 | Germany . | |
| 8022245 | 2/1983 | Japan | 242/595 |
| 846609 | 8/1960 | United Kingdom | 242/595 |

*Primary Examiner*—Donald P. Walsh
*Assistant Examiner*—William A. Rivera
*Attorney, Agent, or Firm*—Birch, Stewart, Kolasch & Birch, LLP

[57] ABSTRACT

An image-forming apparatus comprising a process unit above a feed unit. The feed unit receives material which can selectively be fed from rolls of receiving material rotatably placed in drawers in the feed unit. A channel is formed on a panelling part of the feed unit at a working height for a standing operator. It is possible to place a roll of receiving material provided with a hollow core in the channel in order to introduce a spindle into the roll core. After the fitting of the spindle into the core, the operator can, without moving his position, place the roll of receiving material in an open drawer on bearing blocks disposed therein.

24 Claims, 3 Drawing Sheets

IMAGE-FORMING APPARATUS PROVIDED WITH A SUPPORT FOR A ROLL OF RECEIVING MATERIAL

This application is a continuation of application Ser. No. 08/601,771 filed on Feb. 15, 1996, now abandoned.

FIELD OF THE INVENTION

The invention relates to an image-forming apparatus for forming an image on receiving material unrolled from a roll of receiving material, which roll comprises a hollow roll core in which a spindle fits. The spindle can be rotatably placed in the image-forming apparatus.

DESCRIPTION OF THE BACKGROUND ART

An image-forming apparatus of this kind is known from U.S. Pat. No. 5,244,163. For fitting and securing the spindle in the roll core, it is conventional to manually hold a clamp fixed on the spindle in a position in which the spindle can slide with play into the core. When the required position is reached, the clamp is released to achieve clamping. Particularly in the case of bulky and/or heavy rolls, it is difficult to perform this operation because the spindle must be longer than the widest roll. To form an image on an A0 sheet, the roll must be at least 914 mm wide and the spindle with its journals about 1000 mm long. It is a complex operation to fit a spindle of this length into the core of a roll 914 mm wide and usually about 180 mm thick and hence about 16 kg in weight. It would be possible to use a separate table for this purpose, on which the roll is placed and then the spindle manoeuvred into the roll core using two hands. Apart from the required table, a disadvantage of this is that the roll can easily roll away, with all the consequences thereof, before, during or after this operation. Another disadvantage is that if the place for fitting the spindle into the roll core is chosen arbitrarily, it can readily happen that the spindle is pushed into the roll core from the wrong side and/or the assembly may be incorrectly placed in the image-forming apparatus when the roll is transferred from the spindle introduction station to the roll insertion station.

SUMMARY OF THE INVENTION

The object of this invention is to provide an image-forming device which is intended to obviate these disadvantages.

In an image-forming apparatus which forms an image on receiving material unrolled from a roll, the invention provides support surfaces on an outside of the image-forming apparatus. The support surfaces or points are spaced apart in two directions and extending transversely of one another. The roll of receiving material stably rests on said support surfaces during the fitting of the spindle into the core. Consequently, the roll can be kept at a fixed place during insertion of the spindle and does not need to be manually held in place during the positioning of the spindle in the roll core.

In one embodiment, the support points are formed by two oblique surfaces which face one another and which together form an abutment surface both for a roll of predetermined maximum diameter and for a roll of predetermined minimum diameter. Consequently, irrespective of its diameter between the limits, a roll of receiving material is supported flat and in a stable manner. Accordingly, risk of damage to the receiving material is minimized during the positioning of the spindle in the roll core.

In one embodiment of an image-forming apparatus according to the invention, the support points are disposed on a panelling part directly above the space in which the roll of receiving material can be rotatably placed. Consequently, the place for fitting the spindle in the roll core is situated at the working height of a standing operator and at a short distance from the place where the roll of receiving material can be placed in the image-forming apparatus. The operator therefore does not need to move position between fitting the spindle and placing the roll in the image-forming apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
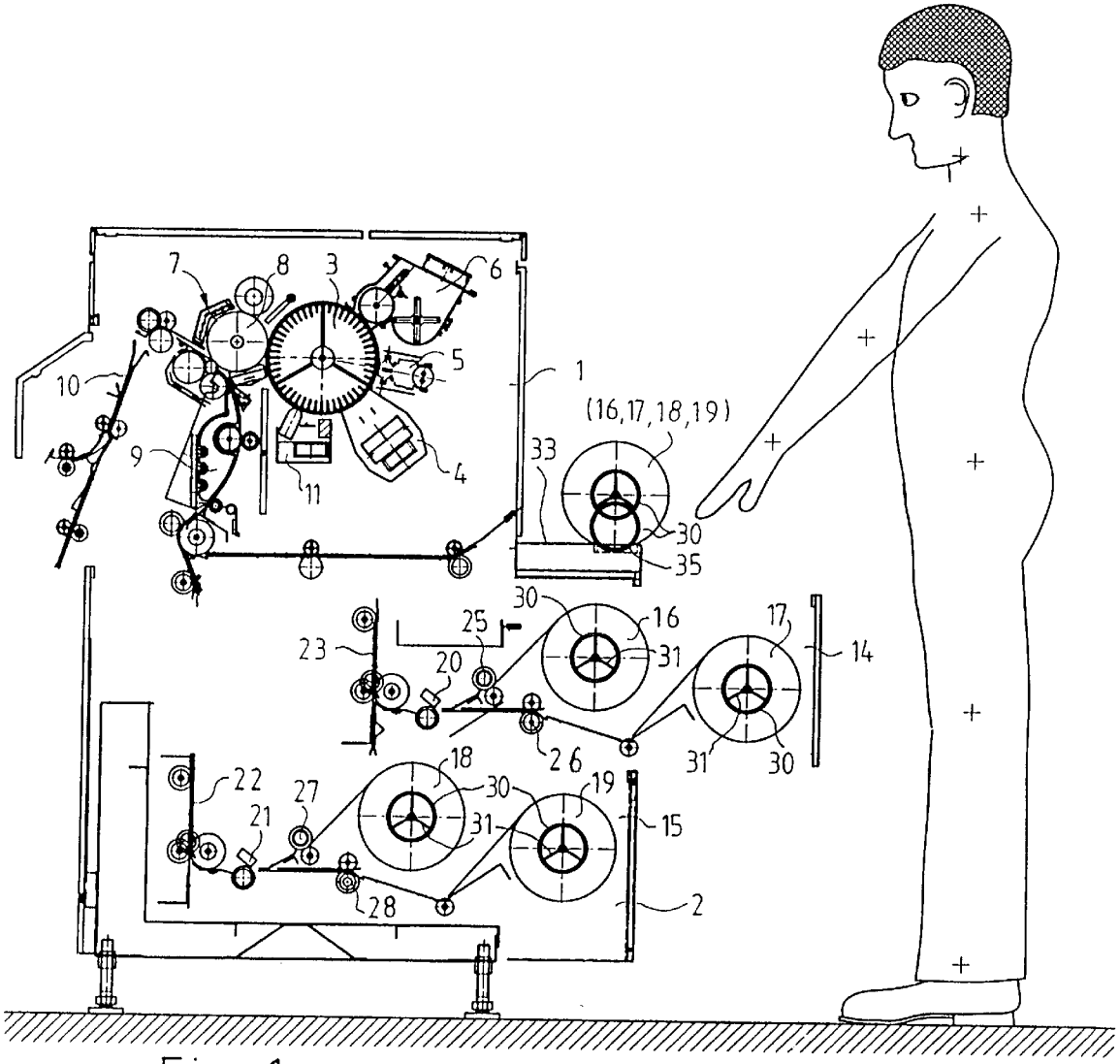
FIG. 1 is a section of an image-forming apparatus according to the present invention.

The image-forming apparatus shown in FIG. 1 comprises an electrophotographic process unit 1 and a feed unit 2 for receiving materials. The process unit 1 is formed by a rotatable photoconductive drum 3 having a working width of at least 914 mm, surrounded by a charging device 4 for charging the photoconductive drum 3. An LED array 5 for image-wise discharge of the charged drum 3, a developing device 6 for developing the remaining charge image on the drum 3 with toner, and an image transfer device 7 for transferring the resulting toner image to an image transfer roller 8 are provided. By heat and pressure, the image is transferred to a receiving material preheated by a heating device 9. The resulting copy leaves the image-forming apparatus via discharge path 10. After the image transfer, the photoconductive drum 3 is regenerated by a regenerating device 11 for a following cycle.

The receiving material is fed to the process unit 1 from a feed unit 2 situated beneath the process unit 1. This feed unit 2 comprises two drawers 14 and 15 disposed one above the other. Each drawer 14 and 15 contains two roll holders for rotatably receiving rolls of receiving material 16 and 17; 18 and 19, respectively. A common cutting device 20, 21 is respectively provided for drawers 14 and 15. The cutting devices 20 and 21 cut off a sheet of unrolled receiving material. Each drawer 14 and 15 also contains a conveyor 22, 23 respectively extending in the vertical direction, for feeding a cut-off sheet of receiving material to the process unit 1 when the drawers are closed. In FIG. 1 the top drawer 14 is shown in a partially open position for replacement of roll 17 and the bottom drawer 15 is shown in the closed operative position.

In the closed position, transport rollers at each roll, denoted by 25, 26, 27 and 28 respectively, unwind receiving material from the selected roll and feed it via the common conveyor 22 and/or 23 to the process unit. During this feed, the associated cutting device 20 or 21 cuts off a sheet of the required length from the continuously moving web of receiving material. Receiving material can be provided in roll form in different widths, varying from a width of 420 mm for transverse feed of an A3 format or longitudinal feed of an A2 format, a width of 600 mm for transverse feed of an A2 format and longitudinal feed of an A1 format, to a width of 914 mm for longitudinal feed of an A0 format and transverse feed of an A1 format. The maximum roll thickness may be approximately 190 mm.

The receiving material is wound around a hollow cardboard roll core 30 having an outside diameter of 86 mm. To accommodate a roll in the feed unit 2, a spindle 31 shown in FIGS. 4 and 5 must be pushed into the roll core 30, said spindle 31 having journals 40 and 41 for rotatable fixing of a roll of receiving material in drawer 14 or 15.

A roll of receiving material of maximum width and maximum thickness has a weight of about 18 kg. With such a bulky and heavy roll it is not easy to insert a long spindle therein without aids, and certainly not if the roll must be in an accurate position with respect to the spindle and which position is not defined by an abutment. This is the case, for example, with central feed of receiving material through the process unit.

On the side where the drawers 14 and 15 open, the feed unit 2 projects beyond the process unit 1 by a distance corresponding approximately to the maximum diameter that a roll of receiving material can have. Given a supply unit height of about 800 mm, a worktop 33 is thus formed at a height suitable for a standing operator. This worktop 33, which is shown in detail in FIG. 2, extends over the entire width of the image-forming apparatus and is adapted for easy insertion and removal of a spindle 31 in the roll core 30 of a roll of receiving material 16, 17, 18 or 19.

For this purpose, near the edge 34 situated opposite the process unit 1, the worktop 33 is provided with a V-shaped channel 35. This channel is formed by two oblique surfaces 36 and 37 each forming an angle of 30° with the worktop 33. The distance between the oblique surfaces 36 and 37 is so selected that they can act as an abutment surface both for a roll of minimum thickness, i.e. the outside diameter (86 mm) of the roll core 30, and a roll of maximum thickness, e.g. a roll having a diameter of 186 mm.

In the case of a minimum roll diameter of 86 mm and a maximum roll diameter of 186 mm, a suitable distance between the oblique surfaces 36 and 37 at worktop height is 70 mm. To be able to push a full feed roll of 18 kg out of the channel at spindle height the minimum force required is 70/186.180N=6.7N, so that stable positioning of the feed roll in the channel is guaranteed.

The shortest distance between the oblique surfaces 36 and 37 is 23 mm, sufficiently small for a roll of minimum size, i.e. the roll core with a thickness of 86 mm. This minimum size roll drops furthest into the channel 37 but does not come into contact with a baseplate 38 fixed as a protection against the bottom edges of the oblique surfaces 36 and 37. Thus a stable position of a roll in the channel 35 is obtained irrespective of the diameter of the roll within the limits.

It will be apparent that to obtain a stable position of a roll of a specific diameter, it is sufficient to have just three support points. Two of the points of contact support the roll on a line situated at some distance on one side of a vertical plane through the center of gravity and the roll axis and one of the points supports the roll at some distance on the other side of said plane. Alternatively, the roll can be positioned along two supporting lines. For example, surface 36 can engage the roll along a first line on one side of the center of gravity of the roll while surface 37 engages the roll along another line on an opposite side of the center of gravity of the roll. These supporting lines are merely the line of contact between the respective surfaces 36, 37 and the roll.

Figure 2:
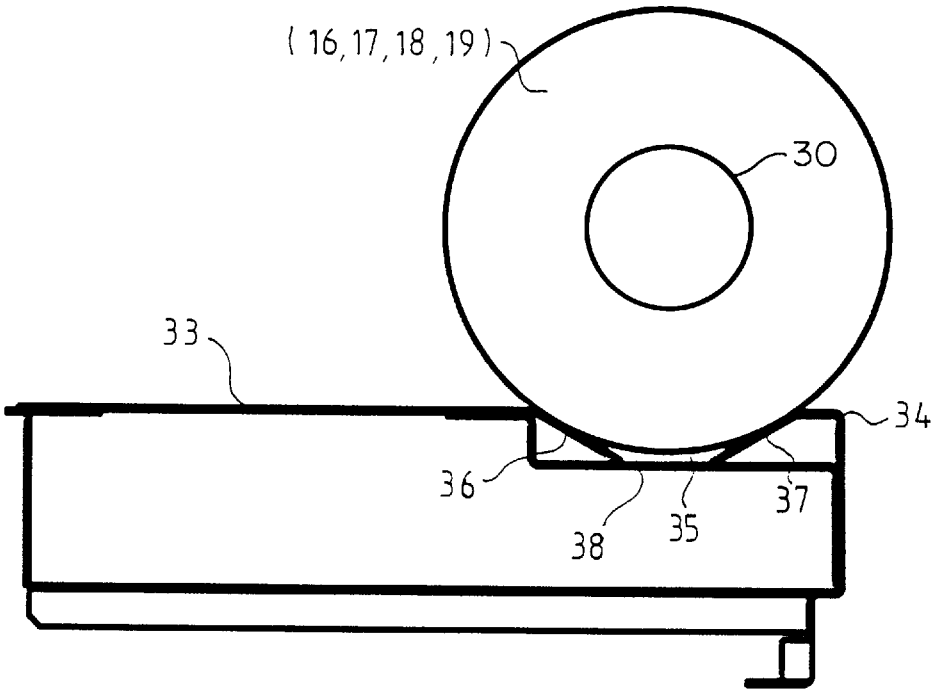
FIG. 2 is a detail of the image-forming apparatus shown in FIG. 1 taken along line II—II of FIG. 3, showing a support for a roll of receiving material during the fitting of the spindle in the roll core.
Figure 3:
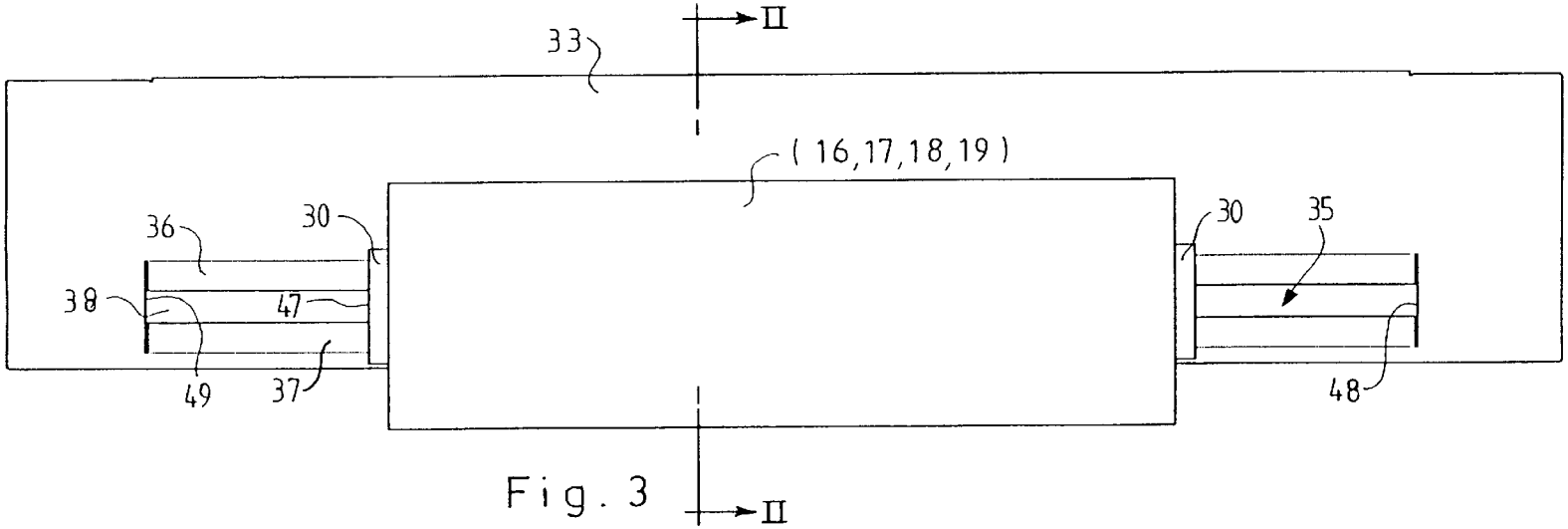
FIG. 3 is a top plan view of the detail shown in FIG. 2.

In the embodiment shown in FIGS. 1 to 3, the channel 35 is formed by a recess in the top plate of the worktop 33 of the roll compartment. An H-shape is cut into the top plate of worktop 33. As seen in FIG. 2, the recess cut in the top plate forms lips which are bent downwardly at an angle to form the oblique abutment surfaces 36 and 37.

Figure 4:
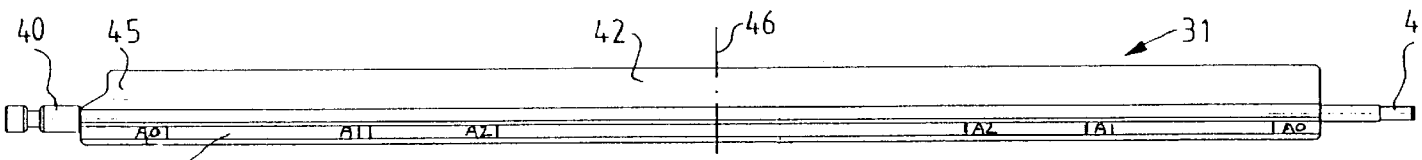
FIG. 4 is a side elevation of the spindle for fitting.
Figure 5:
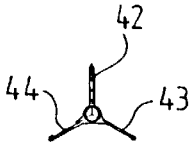
FIG. 5 is a cross-section of the spindle for fitting.

To insert a spindle 31 into a roll core 30 of a roll of receiving material, the roll is placed in the channel 35, e.g. as shown in the top plan view of FIG. 3. As shown in FIG. 4, the spindle 31 is provided with journals 40 and 41 and, therebetween, three radially extending fins 42, 43 and 44, the free ends of which are situated in a cylindrical plane with a diameter somewhat smaller than the inside diameter of the roll core 30. To be able to push the spindle 31 into the roll core 30, a clamp in the middle 46 of the spindle is held to be within the end of the fin 42 by means of a handle (not shown) at the end 45 of the fin 42. The journal 41 of spindle 31 is then first pushed into the roll core on the side indicated by reference 47 in FIG. 3. On insertion and removal, the spindle 31 is always held with the fin 42 in an upright position. Thus during insertion, the format markings provided on the side of the fin 43 facing the operator are an aid for exactly bringing the spindle and the roll core into the required relative positions. When a spindle is pushed out of an empty roll core, the straight upwardly extending fin 42 ensures that the obliquely downwardly extending fins 43 and 44 remain above the top surface 33.

In order to prevent the roll of receiving material from shifting at its ends in the channel 35 during insertion and removal of a spindle 31 from the roll core 30, with the possible risk of damage, the channel 35 is provided with upright walls 48 and 49. During insertion of a spindle, the roll can then be placed against wall 48 and on removal against wall 49.

When the spindle 31 has reached the required position relatively to a roll of receiving material, the handle is released, so that a clamp on fin 42 in the middle 46 presses the roll core in order to axially and tangentially lock the spindle in the roll core.

After a spindle 31 has been fitted in the roll core 30 of a roll of receiving material in the channel 35, the operator can, without changing his position, take hold of the roll on either side by placing his hands in the space between the fins 42 and 43 and the roll core and thus place the roll on bearing blocks in the required place in the drawer 14 or 15 opened for this purpose. A relatively heavy roll can most easily be placed in the top drawer 14 directly behind the loading door because the operator can stand closest to the apparatus when loading this position and thus, in these conditions, the drawer does not have to be opened far. This roll can also easily be placed in the front of drawer 14 because the operator has the least distance to bend.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An image-forming apparatus and support surfaces combination, the image-forming apparatus forming an image on receiving material unrolled from a roll of receiving material, at least one roll of the receiving material being rotatably mounted within the image-forming apparatus at a feed location, the roll of receiving material being mounted on a hollow roll core, the hollow roll core being sized to receive a spindle, the image-forming apparatus and support surfaces combination comprising the support surfaces on an exterior of said image-forming apparatus, the support surfaces being spaced above the feed location which is within the image-forming apparatus, the support surfaces stably holding the at least one roll of receiving material when the roll is placed thereon, the support surfaces being spaced from one another and the roll of receiving material being positionable on the support surfaces at least while the spindle is being inserted into the roll core.

2. The image-forming apparatus and support surfaces combination according to claim 1, wherein the support surfaces are formed by two oblique surfaces which face one another, the two oblique surfaces together form an abutment surface for the roll of receiving material.

3. The image-forming apparatus and support surfaces combination according to claim 2, wherein the roll of receiving material has a longitudinal axis, the oblique surfaces each have a length which is greater than a length of a longest roll of receiving material which is to be placed within the image-forming apparatus, the length of the roll of receiving material being measured in a direction of the longitudinal axis of the roll.

4. The image-forming apparatus and support surfaces combination according to claim 3, wherein the spindle is inserted into the roll core in a direction of the longitudinal axis of the roll of receiving material.

5. The image-forming apparatus and support surfaces combination according to claim 3, further comprising at least one upright edge formed at one end of the oblique surfaces, the at least one upright edge extends between the oblique surfaces and forms an abutment for a roll of receiving material.

6. The image-forming apparatus and support surfaces combination according to claim 5, wherein both ends of the oblique surfaces have an upright edge extending therebetween such that two upright edges are provided, the roll of receiving material being between the two upright edges when the roll is supported on the oblique surfaces.

7. The image-forming apparatus and support surfaces combination according to claim 2, wherein the oblique surfaces are spaced from one another with a distance such that both a roll having a maximum diameter and a roll having a minimum diameter are supportable by the oblique surfaces, only one roll being supported by the oblique surfaces at a time.

8. The image-forming apparatus and support surfaces combination according to claim 2, wherein the oblique surfaces are on a panelling part of the image-forming machine directly above an interior space of the image-forming machine in which at least one roll is rotatably mountable.

9. The image-forming apparatus and support surfaces combination according to claim 8, wherein the interior space of the image-forming machine is formed by at least one drawer, the at least one drawer being movable between an open position and a closed position, the roll of receiving material being insertable into the at least one drawer in the open position, the at least one drawer being beneath the panelling part having the oblique surfaces.

10. The image-forming apparatus and support surfaces combination according to claim 9, wherein two drawers are provided as the at least one drawer, both of the drawers being movable between the open and closed position, both of the drawers being beneath the panelling part having the oblique surfaces.

11. The image-forming apparatus and support surfaces combination according to claim 10, wherein at least two rolls of receiving material are rotatably mountable in each of the drawers.

12. The image-forming apparatus and support surfaces combination according to claim 1, wherein the support surfaces are on an exterior panelling part of the image-forming machine directly above an interior space of the image-forming machine in which at least one roll is rotatably mountable.

13. The image-forming apparatus and support surfaces combination according to claim 12, wherein the interior space of the image-forming machine is formed by at least one drawer, the at least one drawer being movable between an open position and a closed position, the roll of receiving material being insertable into the at least one drawer in the open position, the at least one drawer being beneath the panelling part having the support surfaces.

14. The image-forming apparatus and support surfaces combination according to claim 13, wherein two drawers are provided as the at least one drawer, both of the drawers being movable between the open and closed position, both of the drawers being beneath the panelling part having the support surfaces.

15. The image-forming apparatus and support surfaces combination according to claim 14, wherein at least two rolls of receiving material are rotatably mountable in each of the drawers.

16. The image-forming apparatus and support surfaces combination according to claim 13, wherein the roll of receiving material is insertable into the at least one drawer in the open position in a vertical direction such that the roll is adapted to be lowered into the at least one drawer along a vertical, unslanted path.

17. The image-forming apparatus and support surfaces combination according to claim 1, further comprising an upright edge between one end of the support surfaces, the upright edge extends between the support surfaces and forms an abutment for a roll of receiving material.

18. The image-forming apparatus and support surfaces combination according to claim 17, wherein both ends of the support surfaces have an upright edge extending therebetween such that two upright edges are provided in the image-forming apparatus, each of the upright edges being abutable by the roll of receiving material.

19. The image-forming apparatus and support surfaces combination according to claim 1, wherein the roll of receiving material has a longitudinal axis and wherein the support surfaces are transversely spaced from one another in a direction generally perpendicular to the longitudinal axis of the roll when the roll is on the support surfaces, the support surfaces being fixed in position.

20. The image-forming apparatus and support surfaces combination according to claim 1, further comprising indicia on the spindle for indicating positions for mounting different types of rolls of receiving material on the spindle.

21. The image-forming apparatus and support surfaces combination according to claim 1, wherein the support surfaces engage the roll of receiving material along a length of the roll.

22. An image-forming apparatus and support surfaces combination comprising a printing device in the image-forming apparatus for forming an image on receiving material unrolled from a roll of receiving material, at least one roll of the receiving material being rotatably mounted within the image-forming apparatus, the roll of receiving material being mounted on a hollow roll core, the hollow roll core being sized to receive a spindle, the image-forming apparatus and support surfaces combination having the support surfaces on an exterior of said image-forming apparatus, the support surfaces stably holding the at least one roll of receiving material when the roll is placed thereon, the support surfaces being spaced from one another and the roll of receiving material being positionable on the support surfaces at least while the spindle is being inserted into the roll core.

23. The image-forming apparatus and support surfaces combination according to claim 22, wherein the printing device includes a rotatable drum.

24. The image-forming apparatus and support surfaces combination according to claim 22, further comprising a conveyor for moving the paper past the printing device.

* * * * *